US009797138B2

(12) United States Patent
Sanabra

(10) Patent No.: US 9,797,138 B2
(45) Date of Patent: Oct. 24, 2017

(54) CONSTRUCTIVE SYSTEM AND METHOD OF CONSTRUCTION THEREOF

(71) Applicant: Elastic Potential, S.L., Barcelona (ES)

(72) Inventor: Marc Sanabra, Barcelona (ES)

(73) Assignee: ELASTIC POTENTIAL, S.L., Barcelona (ES)

( * ) Notice: Subject to any disclaimer, the term of this patent is extended or adjusted under 35 U.S.C. 154(b) by 105 days.

(21) Appl. No.: 14/702,359

(22) Filed: May 1, 2015

(65) Prior Publication Data

US 2016/0319541 A1 Nov. 3, 2016

(51) Int. Cl.

| | |
|---|---|
| ***E04C 5/08*** | (2006.01) |
| ***E04B 5/04*** | (2006.01) |
| ***E04B 5/19*** | (2006.01) |
| ***E04B 5/26*** | (2006.01) |
| ***E04B 5/48*** | (2006.01) |

(52) U.S. Cl.

CPC ..... *E04C 5/08* (2013.01); *E04B 5/043* (2013.01); *E04B 5/19* (2013.01); *E04B 5/265* (2013.01); *E04B 5/48* (2013.01); *E04B 2103/02* (2013.01)

(58) Field of Classification Search

CPC ..... E04B 5/023; E04B 5/043; E04B 5/046; E04B 5/04; E04B 5/06; E04B 5/08; E04B 5/17; E04B 5/26; E04B 5/48; E04B 5/265; E04B 5/19; E04B 2103/02

See application file for complete search history.

(56) References Cited

U.S. PATENT DOCUMENTS 758,728 A * 5/1904 Wight et al. ..... E04B 5/40 52/250
2,004,991 A * 6/1935 Klotz ..... E04B 5/046 52/479
2,075,560 A * 3/1937 Wright ..... E04B 5/046 52/434
2,215,975 A * 9/1940 Rackle ..... E04B 5/04 52/440
2,490,527 A * 12/1949 Ledbetter ..... E04B 5/23 249/23
4,574,545 A * 3/1986 Reigstad ..... E04G 23/0218 264/228
4,628,654 A * 12/1986 Boswel ..... E04B 5/40 52/319
4,682,458 A * 7/1987 Sparrow ..... E04B 5/046 52/309.8

(Continued)

*Primary Examiner* — Adriana Figueroa
*Assistant Examiner* — Jessie T Fonseca

(57) ABSTRACT

Constructive system comprising at least four modular elongated prefabricated floor elements, each floor element defining a longitudinal axis parallel to its long side and a transversal axis parallel to its short side, and being arranged coplanar in a 2×2 matrix configuration such that each floor element is adjacent to another element by one of its long sides and adjacent to another of the elements by one of its short sides, the ends of the short sides of the floor elements resting on linear supporting elements, the floor elements comprising in the vertical face of each of the long sides a longitudinal groove having the direction of the longitudinal axis such that a cavity is formed between each pair of adjacent floor elements, the cavities being filled with a grouting, the system including at least one duct extending continuously along the two cavities and a post-tensioned tendon within the duct.

15 Claims, 7 Drawing Sheets

(56) References Cited

U.S. PATENT DOCUMENTS

| | | | | |
|---|---|---|---|---|
| 5,701,707 | A * | 12/1997 | Sorkin | E04C 5/12 52/223.13 |
| 2003/0093965 | A1 * | 5/2003 | Miller | E04B 5/046 52/600 |
| 2004/0065030 | A1 * | 4/2004 | Zambelli | E04B 1/21 52/223.13 |

* cited by examiner

CONSTRUCTIVE SYSTEM AND METHOD OF CONSTRUCTION THEREOF

TECHNICAL FIELD

The present invention relates to the field of modular constructive systems using prefabricated floor elements that rest on linear supporting elements, such as walls or beams. More specifically, the invention is related with those systems in which the floor elements comprise in the vertical face of each of the long sides a longitudinal groove having the direction of the longitudinal axis such that a cavity is formed between each pair of adjacent floor elements. This cavity is destined to be finally filled with a grouting, forming the so-called shear key, which allows to connect the adjacent floor elements with a connection capable of transmitting vertical shear forces.

STATE OF THE ART

Known are in the art constructive systems comprising at least four modular elongated prefabricated floor elements, each floor element defining a longitudinal axis parallel to its long side and a transversal axis parallel to its short side, the floor elements being arranged coplanar in a 2×2 matrix configuration such that each floor element is adjacent to another floor element by one of its long sides and adjacent to another of the floor elements by one of its short sides, the ends of the short sides of the floor elements resting on linear supporting elements, the floor elements comprising in the vertical face of each of the long sides a longitudinal groove having the direction of the longitudinal axis such that a cavity is formed between each pair of adjacent floor elements, the cavities being filled with a grouting.

FIG. 9 shows the basic components of this type of constructive system. The resulting connection, after grouting is called shear key, and it is not unusual that some passive reinforcement is placed therein.

Two main drawbacks of these constructive systems are their low structural redundancy and the fact the floor elements are not suited to resist negative moments. Additionally negative moments due to service forces are particularly harmful to this elements, as they sum up to the negative moment due to prestress and may lead to cracking in the upper face of floor elements. That is why, these elements are often designed to work as pinned-pinned, and the bearing sections have no negative moment reinforcement. As a result, these sort of floor elements have bigger depths and/or bigger amounts of prestressed steel than equivalent undetermined structures.

In order to obtain moment-resistant junctions at bearing sections, it is not unusual to place passive reinforcement at these sections. This is usually done by providing grooves at the upper surface at the ends of the floor elements, inserting a passive reinforcement that passes over the supporting beam, and then grouting the grooves. This is a complicated solution that provides for some continuity between slabs, and that allows the moments diagram to rise (increasing negatives and reducing positives). However, this sort of solution has practical drawbacks since it involves complicated terminations of floor elements, and expensive costs in situ (work force and material consumption). Moreover, the weight of elements increases due to the amount of grouting. Finally, the upper face of floor elements is more likely to crack due to the sum of the negative moment due to prestress and the negative moment due to service forces.

On the other hand, it is also common to use double T floor elements, also named Pi-Girder. These floor elements are made of a flat flange and two vertical webs placed generally at one quarter and three quarter of the width. One drawback of these floor elements is that the faces where they are laterally adjacent to another floor element are very small. Therefore, in this type of floor elements a shear force transmission poses a technical problem, since the area for transmitting them is very limited.

A solution is to assign this function to the compression layer placed on top of the floor elements. Another solution is to place small steel inserts that cross the gap between floor elements. This solution is expensive as it complicates precasting.

DESCRIPTION OF THE INVENTION

For overcoming the mentioned drawbacks, the present invention provides for a constructive system comprising at least four modular elongated prefabricated floor elements, each floor element defining a longitudinal axis parallel to its long side and a transversal axis parallel to its short side, the floor elements being arranged coplanar in a 2×2 matrix configuration such that each floor element is adjacent to another floor element by one of its long sides and adjacent to another of the floor elements by one of its short sides, the ends of the short sides of the floor elements resting on linear supporting elements, the floor elements comprising in the vertical face of each of the long sides a longitudinal groove having the direction of the longitudinal axis such that a cavity is formed between each pair of adjacent floor elements, the cavities being filled with a grouting, characterized in that it comprises at least one duct which extends continuously along the two cavities and a post-tensioned tendon inserted within the duct.

The floor system may or may not include a topping reinforced slab poured on the site. Therefore, the idea underlying the invention is placing continuous post-tensioned reinforcement along profound cavities formed amid pairs of the floor elements and grouting those cavities and the space between the ends of floor elements and the bearing element, getting both continuity of the concrete section and the reinforcement through de bearing lines.

The effects of the invention are:

- Moment-resistant junctions on the bearing lines of floors, allowing a strong reduction of the deflection of floors, and reducing the positive moments in the bays.
- Shortly, the efficiency of the floors is very much improved, leading to a reduction of the depth of the floors and a reduction of materials consumption. Consequently the overall weight of the floor is reduced, leading subsequently to a reduction of the forces acting upon the support elements.
- Cantilevers may be formed, which are typically almost impossible to solve with conventional precast prestressed floor elements solutions.
- Similar improvements may be achieved in precast prestressed or reinforced beams (support lines), in the case post-tensioning tendons are placed along them passing from bay to bay above bearings (columns).
- Increase in the lateral-forces strength and stiffness of the structure.
- Increase in the redundancy of the structure. This leads to an increase in the resiliency of the structure, which implies a better behavior under accidental situations and loads.

Avoids the need of steel inserts in the edges of narrow vertical faces of the long sides, to transmit shear-typical issue in double-T slabs or similar floor elements. This need is avoided because there are no narrow contact vertical faces, and shear is properly transmitted by the grouting placed in the convenient lateral grooves.

Typically, the duct is arranged in the cavities such that in the longitudinal middle of each floor element, the duct is placed at the lower part of the cavity and such that at the linear supporting element level the duct is placed at the upper part of the cavity. But other layout of the tendons may be used to conveniently counteract service forces. For example, in cantilevers the tendon will not normally go under the axis of the floor element.

The system may include the following features, which can be combined whenever it is technically possible:

each tendon consists of a wire, a strand, a cable, or a plurality or combination thereof.

grooves occupy almost all the vertical face of each of the long faces of the floor elements.

the linear supporting elements define an upper surface, and the floor elements rest on the linear supporting elements, such that an upper portion of the cavities is above the upper surface of the linear supporting elements, the duct being arranged in said upper portion of the cavities. As an alternative, the linear supporting elements are provided on their top with grooves or through holes for the passage of the duct or tendon. In other words, generally the supporting beams will have horizontal surfaces oriented in the up direction, a lower, generally in both sides of the beam, for supporting the floor elements, and another one, the upper surface, corresponding to the web or webs of the beam, or the central part thereof.

all or some of the linear supporting elements are walls all or some of the linear supporting elements are precast beams including prestressed or passive reinforcement in their lower part.

the section of the beams is such (inverted T, U-shape, etc.) that it allows the placement of post-tensioning tendons along the beams. In these cases columns may need a proper design to allow the tendons passing through them, or tendons may pass by columns.

the floor elements are reinforced or prestressed concrete elements formed by a planar flange, two lateral half-webs (or half stems), the half-webs being reinforced or prestressed at their lower sections, the half-webs being provided on the external vertical face with said groove; preferably, the floor elements comprise a central web, such that when the floor elements are placed adjacent, the same configuration as in a double T-beam floor is achieved. As an alternative, the floor elements are hollow core slabs. Other floor elements applicable to the invention are disclosed in the References 1 and 2.

Advantageously, the surface of the longitudinal groove is rugous, to improve the transfer of compression forces from the grouted cavity to the adjacent precast elements.

The cavity may house two or more ducts with a tendon inserted therein.

The floor system may include a topping reinforced slab poured in the place. In this case, the upper face of support elements may or may not be lower that the upper face of floor elements, as the topping slab may be thick enough to enable the tendon to pass into it and avoid an interference with the support element.

The invention also relates to a method for erecting a constructive system which comprises at least four modular elongated prefabricated floor elements, each floor element defining a longitudinal axis parallel to its long side and a transversal axis parallel to its short side, the floor elements comprising in the vertical face of each of the long sides a longitudinal groove having the direction of the longitudinal axis, the method comprising the steps of:

a) placing precast linear supporting elements (frames or walls) spaced between each other, or building on site those;

b) resting the ends corresponding to the short sides of the floor elements on the linear supporting elements such that the floor elements are arranged coplanar in a 2×2 matrix configuration and such that each floor element is adjacent to another floor element by one of its long sides and adjacent to another of the floor elements by one of its short sides, and such that a cavity is formed between each pair of adjacent floor elements;

c) arranging at least one duct which extends continuously along the two cavities and a tendon inserted within the duct;

d) filling the cavities with a grouting;

e) tensioning and anchoring the tendon once the grouting has hardened.

Preferably, in said method, the duct is arranged in the cavities such that in the longitudinal middle of each cavity, the duct is placed at the lower part of the cavity and such that at the linear supporting element level the duct is placed at the upper part of the cavity. However, other layouts of the tendons may be adjusted to properly counteract the effects of service forces.

Finally, in step c) the duct and the tendon may be placed simultaneously.

BRIEF DESCRIPTION OF THE DRAWINGS

To complete the description and in order to provide for a better understanding of the invention, a set of drawings is provided. Said drawings form an integral part of the description and illustrate an embodiment of the invention, which should not be interpreted as restricting the scope of the invention, but just as an example of how the invention can be carried out. The drawings comprise the following figures.

DESCRIPTION OF A WAY OF CARRYING OUT THE INVENTION

Figure 9:
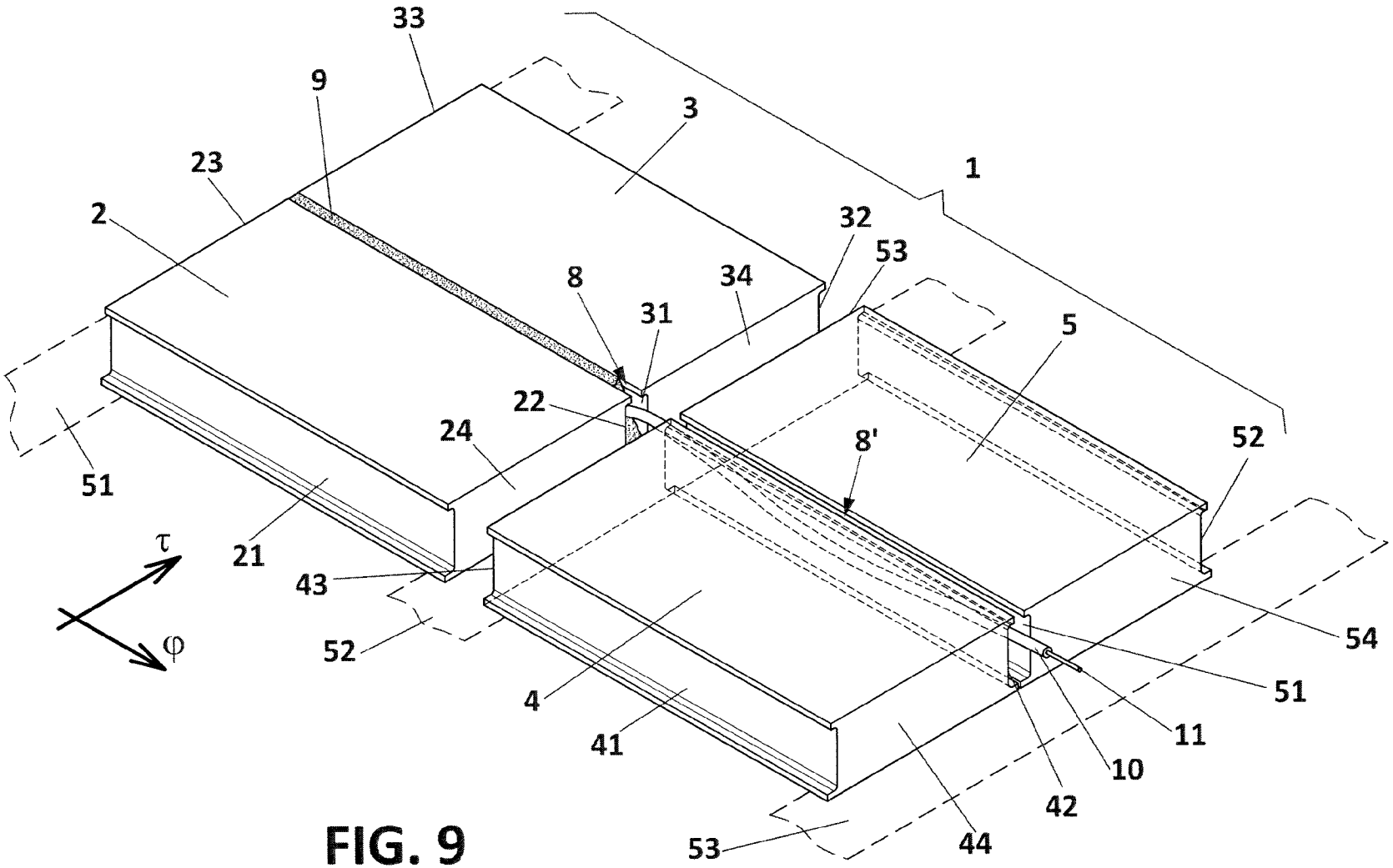
FIG. 9 shows a perspective view showing the main components of the structure of the present invention.
Figure 10:
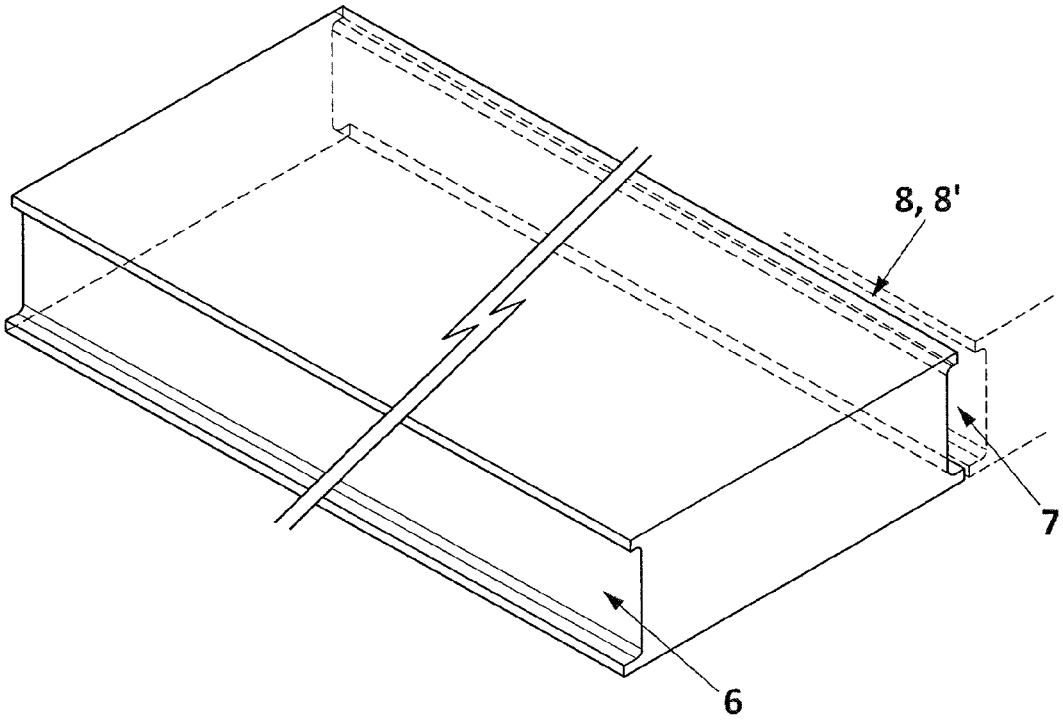
FIG. 10 shows a basic floor element, and the cavity formed when put beside a similar basic floor element.

As depicted in FIGS. 9 and 10, the present invention relates to a constructive system 1 comprising at least four modular elongated prefabricated floor elements 2, 3, 4, 5, each floor element 2, 3, 4, 5 defining a longitudinal axis $\phi$ parallel to its long side and a transversal axis $\tau$ parallel to its short side, the floor elements 2, 3, 4, 5 being arranged coplanar in a 2×2 matrix configuration such that each floor element 2, 3, 4, 5 is adjacent to another floor element 2, 3, 4, 5 by one of its long sides and adjacent to another of the floor elements 2, 3, 4, 5 by one of its short sides.

The four floor elements represent the minimum components of a structure that can take the advantage of the invention, but obviously it is applicable to more elements, with more elements in more directions.

The ends of the short sides 23, 24, 33, 34, 43, 44, 53, 54 of the floor elements 2, 3, 4, 5 rest on linear supporting elements S1, S2, S3 and the floor elements 2, 3, 4, 5 comprise in the vertical face F8, F8' of each of the long sides 21, 22, 31, 32, 41, 42, 51, 52 a longitudinal groove 6, 7 having the direction of the longitudinal axis $\phi$.

Then, between each pair of adjacent floor elements a cavity 8, 8' is formed. The section of this cavity has the shape of a key, and then, when the cavities 8, 8' are filled with a grouting 9, the resulting element after hardening is called a shear key, since it can transmit vertical forces between adjacent floor elements or slabs.

Specifically, according to the present invention, the system comprises at least one duct 10 which extends continuously along the two cavities 8, 8' and a post-tensioned tendon 11 inserted within the duct 10.

Then, the tendon allows to link the moment's diagrams of the two floor elements, and specially, rise up the moment's diagram, in a controlled manner, such that the floor elements can withstand higher loads, or equivalently, be dimensioned with smaller dimensions.

Preferably, in all the embodiments, the surface of the longitudinal groove is rugous.

In all the embodiments of the invention, there can be two or more ducts with a tendon in the cavities.

Figure 2:
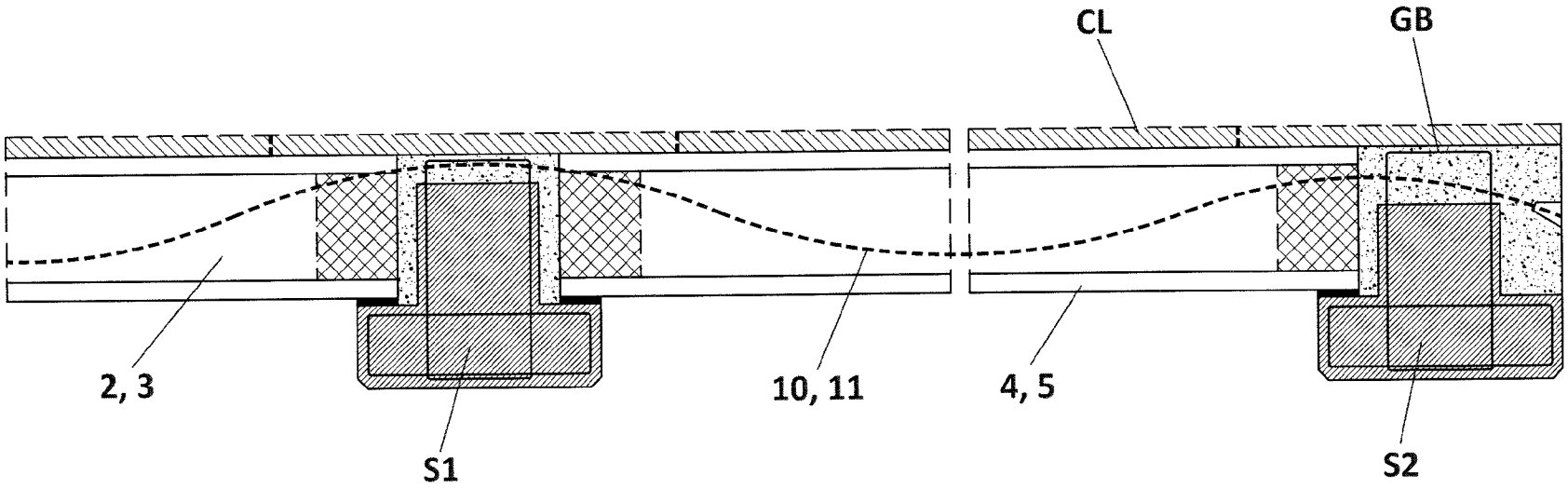
FIG. 2 shows a lateral cross-section taken along the floor element, specifically showing in projection line -dashed- an advantageous position of the duct and the tendon.

More preferably, as shown in FIGS. 2 and 9, the duct 10 is arranged in the cavities 8, 8' such that in the longitudinal middle of each floor element 2, 3, 4, 5, the duct is placed at the lower part of the cavity 8, 8' and such that at the linear supporting element S2 level the duct is placed at the upper part of the cavity 8, 8'. Therefore, the tendon is adapted to withstand positive-moments in the middle of the bay (or span) and to withstand negative moments upon the supporting element S2.

The tendon 10 can be a wire, a strand, a cable, or a plurality or combination thereof.

Figure 1:
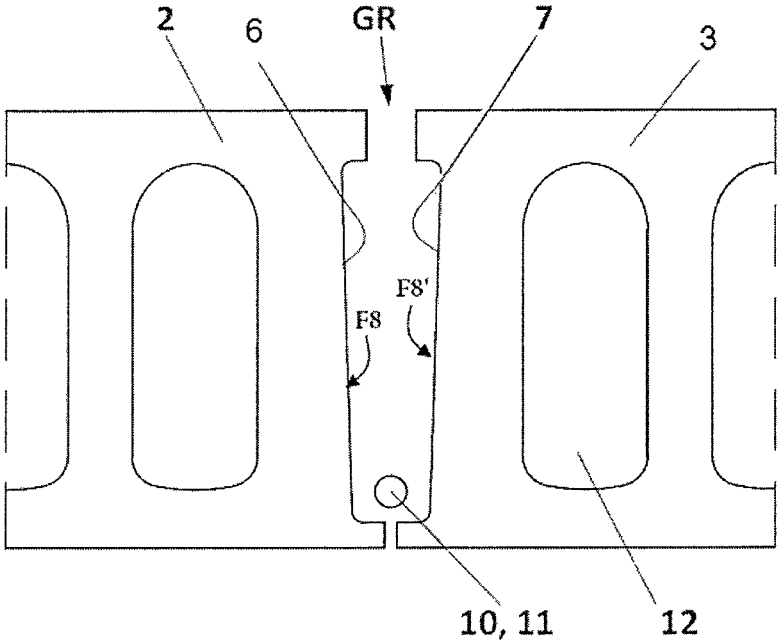
FIG. 1 is a cross section showing a shear key between two floor elements, with a tendon in the lower part.

As shown for example in FIG. 1, and known in the art per se, the groove 6, 7 occupies almost all the vertical face F8, F8' of the floor elements 2, 3, 4, 5. The groove can be formed by providing protrusions in the lower and in the upper part, as shown in FIG. 9 too. However, it is also common to replace the upper tabs or protrusions by another groove in the main groove, as a way to obtain a proper shear key.

Figure 3:
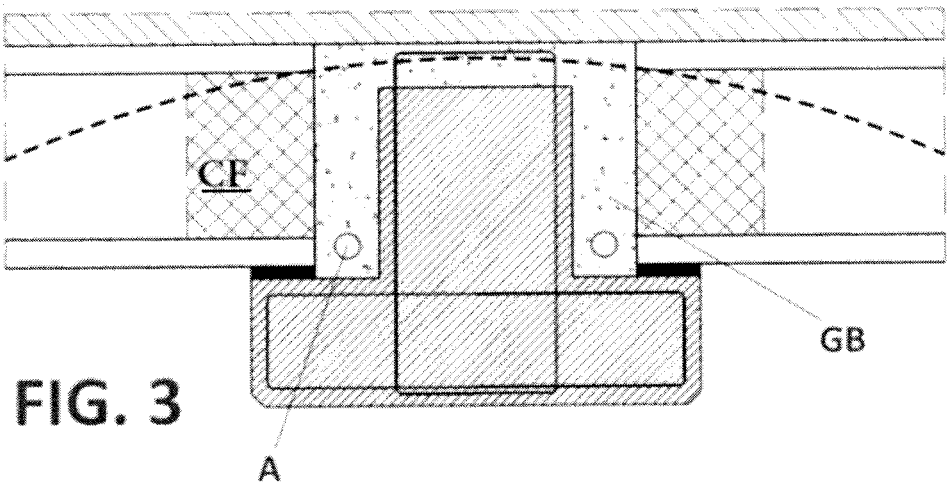
FIGS. 3, 4 and 5 show some details of the system at the junction of floor element and their supporting element.
Figure 4:
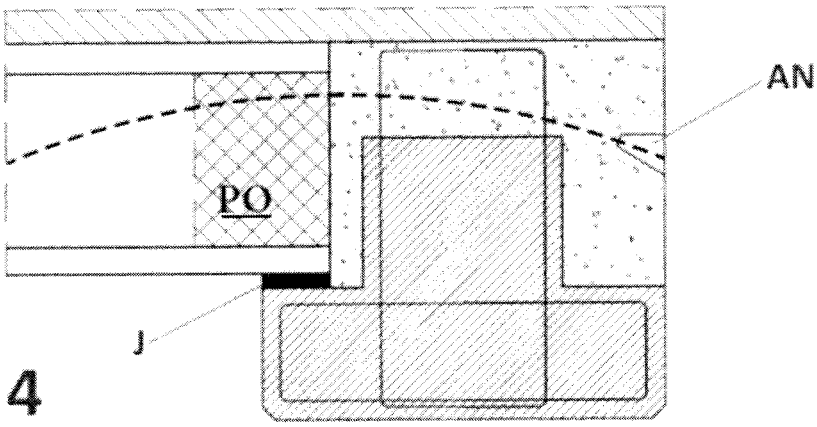
Figure 5:
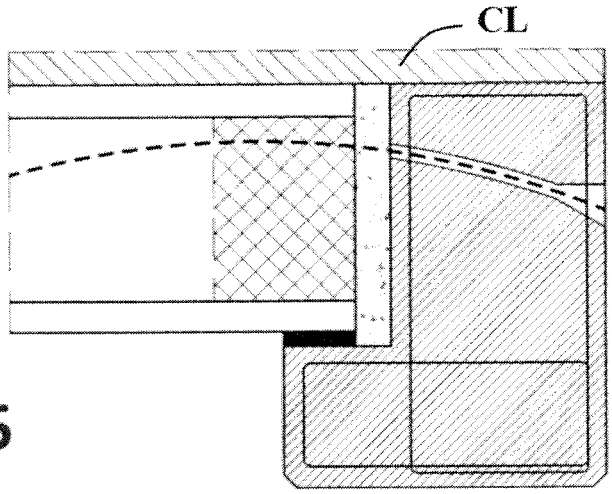

The linear supporting elements define a resting surface, wherein the floor elements 2, 3, 4, 5 rest on the linear supporting elements S1, S2, S3, and an upper surface at a level above the resting surface such that an upper portion of the cavities 8, 8' is above the upper surface of the linear supporting elements S1, S2, S3, the duct 10 being arranged in said upper portion of the cavities 8, 8'. Therefore, the duct can pass from one side of the supporting element, to the other side, as shown in FIG. 3 for example. Some of the linear supporting elements are beams including prestressed or passive reinforcement armatures in their lower part.

As an alternative to a lower height of the upper surface of the supporting beam, the linear supporting elements S1, S2, S3 can be provided on their top with grooves or through holes for the passage of the duct 10 and tendon 11 inserted in the duct.

Another possibility is that the duct and the tendon, when passing above the supporting beam, pass over the level of the upper surface of the element, and is embedded in the compression layer CL. In this case, the central part of the supporting beam can be flush with the upper surface of the floor element.

The linear supporting elements S1, S2, S3 can be beams reinforced with passive or active armatures in their lower part.

Also, and as shown in FIG. 3 the spaces between the ends of the floor elements and the beams, in this case the latter having an inverted T shape, are filled with a grouting GB. In order to prevent the grouting from spilling out (open soffit floor elements) or to enter the floor element (closed soffit floor element), an obstructive element or part must be placed at the end of the floor element. As shown in FIG. 3, hollow core holes are obstructed at their ends with a cap or a filling (CF).

Still in FIG. 3 post-tensioning reinforcement are shown both parallel to the floor elements and parallel to the beam (in the transversal direction $\tau$). This feature allows the reduction of the depth and of materials consumption in beams. In hollow-core slab floors, similar—but more imperfect and costly—moment-resisting junctions are obtained nowadays by using passive reinforcement instead of post-tensioned reinforcement on the bearings placed parallel to floor elements. However, when it comes to double-T beams, even the passive reinforcement solution is unexisting today. This is nowadays impossible to do with double-T beams.

Figure 6:
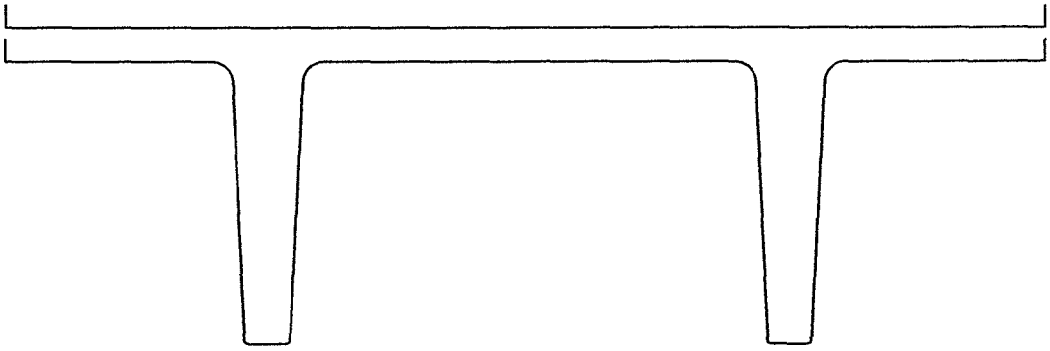
FIG. 6 PRIOR ART
FIG. 6 shows a typical double-T floor element as it is nowadays typically designed in the United States.
Figure 7:
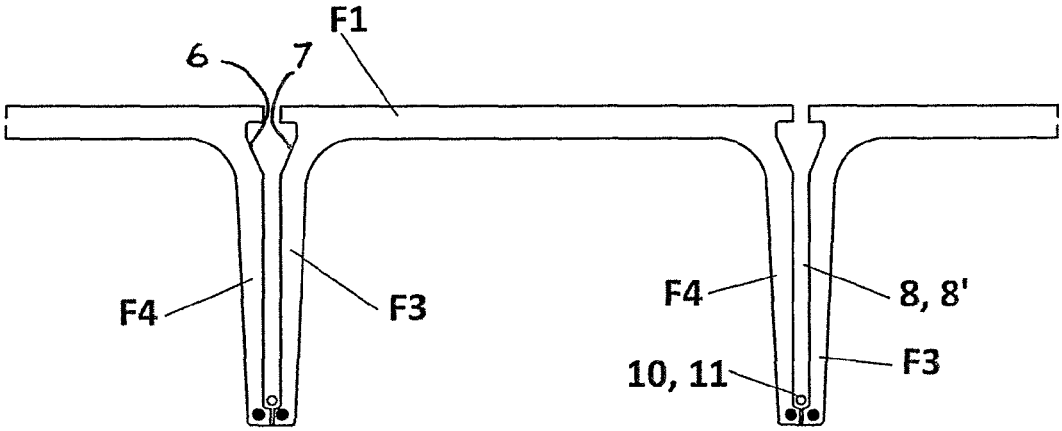
FIGS. 7 and 8 show the element depicted in FIG. 6, yet adapted to the present invention.

As shown in FIG. 7, an inventive version of the floor elements 2, 3, 4, 5 are reinforced or prestressed concrete elements formed by:

- a planar upper flange F1;
- two lateral half-webs F3, F4;
- the webs being reinforced at their lower sections;
- the half webs being provided on the external vertical face with said groove 6, 7;

This floor element is conceived to replace the existing floor elements such as the floor element shown in FIG. 6.

Figure 8:
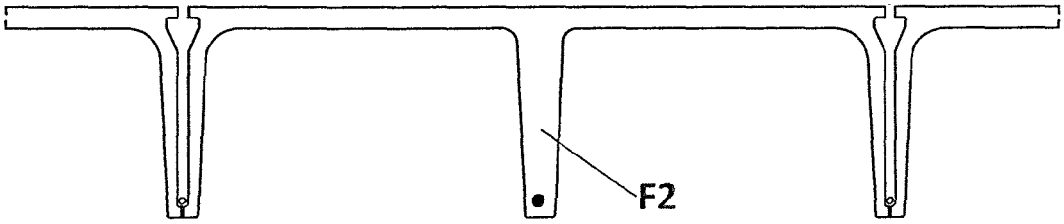

A different version of the floor elements 2, 3, 4, 5 and which cross section is shown in FIG. 8 comprises a central web F2, such that when the floor elements 2, 3, 4 ,5 are placed adjacent, the same configuration as a conventional double T-beam floor configuration is achieved.

Another version of the floor elements 2, 3, 4, 5 are slabs provided with longitudinal alveoli 12, usually referred as hollow core slabs.

Figure 11:
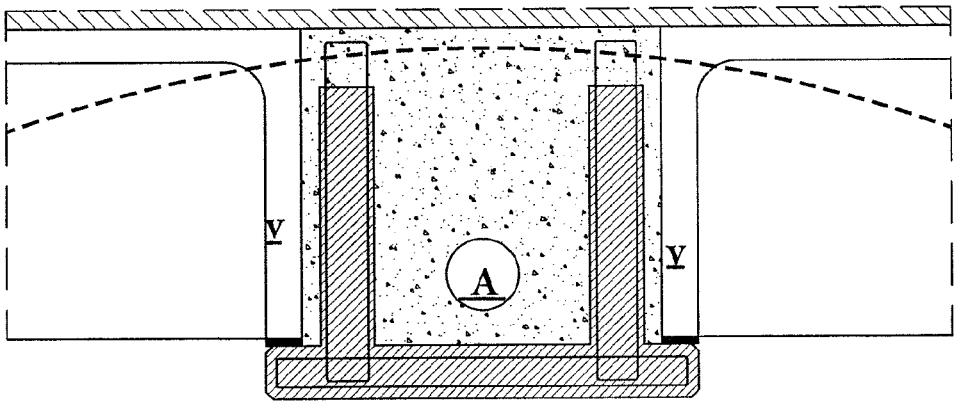
FIG. 11 shows in detail a supporting zone when double-T floor elements are used.
Figure 12:
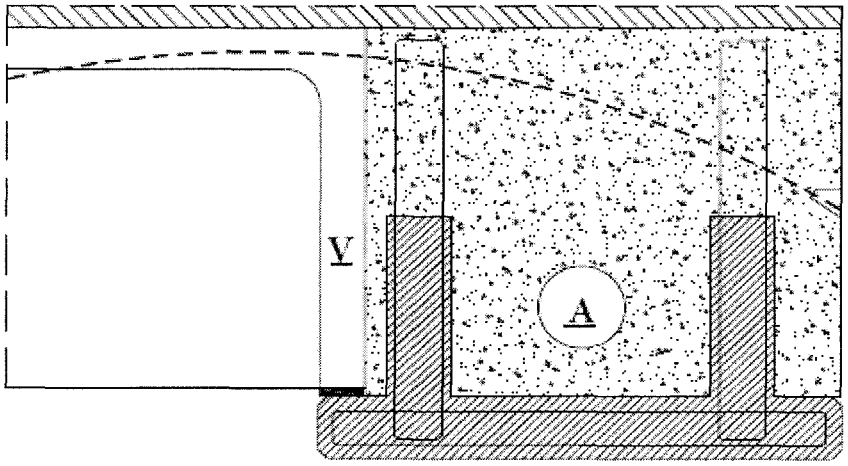
FIG. 12 shows in detail a terminal supporting end when double-T floor elements are used.
Figure 13:
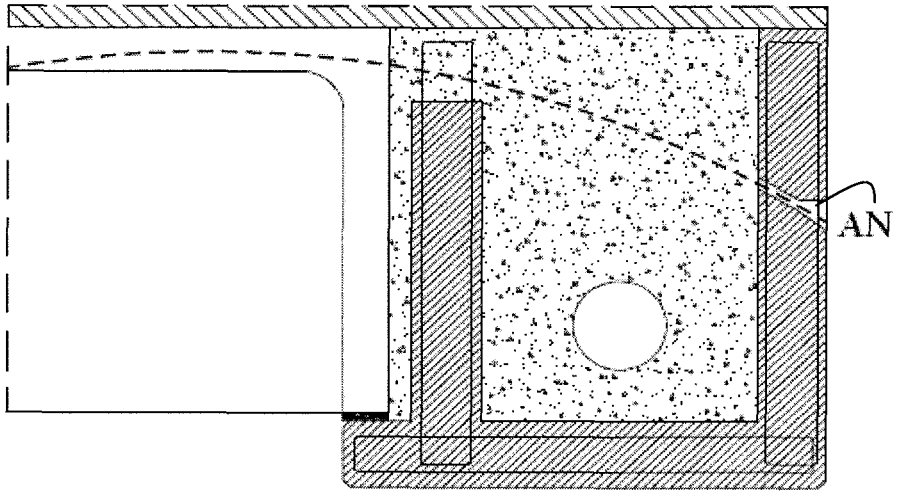
FIG. 13 shows in detail a terminal supporting end when double-T floor elements are used, in a solution where no formworks are necessary.

As shown in FIGS. 11 to 13, the floor elements as those disclosed in FIGS. 7 and 8 comprise in their ends a vertical flange or wall V destined to rest on the supporting beams, eventually with the interposition of a polymer joint. This vertical flange has another function, consisting in serve as a formwork for the grouting placed around the supporting element. As shown in FIGS. 11 to 13, the supporting beam has an inverted double T shape, or a U shape provided with two lateral tabs for supporting the floor elements. The vertical webs of the supporting beams may have a height almost as tall as the height of the floor element, as shown in FIG. 11 or a lower height, as shown in FIG. 12, destined to allow the passage of the duct and the tendon inserted therein. In the least case (FIG. 12), a lateral formwork is necessary for grouting the resulting free spaces at the supporting section. For overcoming this need, a different section is proposed in FIG. 13, wherein the end (or border) web takes all the height of the floor element, and therefore serves as a formwork. The interior web is slightly shorter for allowing the passage of the duct and the tendon, the latter being anchored at the end (or border) web.

The invention also relates to a method for erecting a constructive system 1 which comprises at least four modular elongated prefabricated floor elements 2, 3, 4, 5, each floor element 2, 3, 4, 5 defining a longitudinal axis $\phi$ parallel to its long side and a transversal axis $\tau$ parallel to its short side, the floor elements 2, 3, 4, 5 comprising in the vertical face of each of the long sides 21, 22, 31, 32, 41, 42, 51, 52 a longitudinal groove 6, 7 having the direction of the longitudinal axis $\phi$, the method comprising the steps of:

a) placing precast linear supporting elements (frames or walls) S1, S2, S3 spaced between each other, or building on site those;

b) resting the ends corresponding to the short sides of the floor elements 2, 3, 4, 5 on the linear supporting elements S1, S2, S3 such that the floor elements 2, 3, 4, 5 are arranged coplanar in a 2×2 matrix configuration and such that each floor element 2, 3, 4, 5 is adjacent to another floor element 2, 3, 4, 5 by one of its long sides and adjacent to another of the floor elements 2, 3, 4, 5 by one of its short sides, and such that a cavity 8, 8' is formed between each pair of adjacent floor elements;

c) arranging at least one duct 10 which extends continuously along the two cavities 8, 8' and a tendon 11 inserted within the duct 10;

d) filling the cavities 8, 8' with a grouting 9;

e) tensioning and anchoring the tendon once the grouting 9 has hardened.

As shown in FIG. 9, the duct 11 is arranged in the cavities 8, 8' such that in the mid of the span the duct is placed at the lower part of the cavity 8, 8' and such that at the linear supporting element S2 level the duct is placed at the upper part of the cavity 8, 8'.

In the step c the duct 10 and the tendon 11 may are placed simultaneously or the tendon may be threaded in the duct after the least in placed.

The system is completed with the following known features:

A cap or filling element PO placed at the ends of the floor elements and intended to cover the longitudinal alveoli of the floor elements, in case the floor elements are provided thereof.

A compression layer CL may be placed on top of the floor elements, once the grouting between floor elements has been carried out.

In summary, the present invention, by the strategic use of posttensioning elements extending through many precast floor elements, allow for a reduction of depth and reduction in materials consumption.

In this text, the term "comprises" and its derivations should not be understood in an excluding sense, that is, these terms should not be interpreted as excluding the possibility that what is described and defined may include further elements or steps.

The invention is obviously not limited to the specific embodiments described herein, but also encompasses any variations that may be considered by any person skilled in the art, within the general scope of the invention as defined in the claims.

REFERENCES

1. Park, Hesson. 2003. "Model-based Optimization of Ultra-High Performance Concrete Highway Bridge Girders." M. S. Thesis, Massachusetts Institute of Technology
2. Keierleber, Bierwagon, Fanous, Phares, Couture 11, 2007, "Design of Buchanan County, Iowa, Bridge Using Ultra High Performance Concrete and PI Girders", Proceedings of the 2007 Mid-Continent Transportation Research Symposium, Ames, Iowa, August 2007

The invention claimed is:

1. Constructive system comprising at least four modular elongated prefabricated floor elements, each floor element defining a longitudinal axis parallel to long sides of the floor element and a transversal axis parallel to short sides of the floor element, the floor elements being arranged coplanar in a 2×2 matrix configuration such that each floor element is adjacent to another floor element by one of the long sides of the floor element and adjacent to another of the floor elements by one of the short sides of the floor element, the ends of the short sides of the floor elements resting on linear supporting elements, the floor elements comprising in a vertical face of each of the long sides a longitudinal groove having the direction of the longitudinal axis such that a cavity is formed between each pair of adjacent floor elements by one of the long sides of the floor elements, the cavities being filled with grouting, characterized in that the system comprises at least one duct which extends continuously along the two cavities and a post-tensioned tendon inserted within the duct whereby the grouting in each cavity and corresponding longitudinal groove result in a shear key between the prefabricated floor elements and in the grouting capable of transmitting vertical shear forces, and wherein the duct is arranged along the two cavities so that in a midspan of each cavity formed between each pair of adjacent floor elements, the duct is placed at the lower part of the cavities and such that at a level of each linear supporting element the duct is placed at the upper part of the cavities.

2. The constructive system according to claim 1, wherein the longitudinal grooves occupies almost all of the vertical faces of the floor elements.

3. The constructive system according to claim 1, wherein the linear supporting elements define a resting surface for supporting the floor elements and an upper surface at a level above the resting surface, wherein the floor elements rest on the linear supporting elements, such that the upper part of the cavities is above the upper surface of the linear supporting elements.

4. The constructive system according to claim 1, wherein the linear supporting elements are provided on their top with grooves or through holes for the passage of the duct or tendon.

5. The constructive system according to claim 1, wherein the floor elements are reinforced or prestressed concrete elements formed by:

a planar flange;

two lateral half-webs;

the two lateral half-webs being reinforced at their lower sections; and the half-webs being provided on the external vertical face with each longitudinal groove.

6. The constructive system according to claim 5, wherein the floor elements comprise a central web, such that when the floor elements are placed adjacent floor elements of the same configuration, a double T-beam floor is achieved.

7. The constructive system according to claim 1, wherein the floor elements are hollow core slabs.

8. The constructive system according to claim 1, wherein all or some of the linear supporting elements are walls.

9. The constructive system according to claim 1, wherein the linear supporting elements have a U-inverted section, a pi girder inverted section, or a T inverted section.

10. The constructive system according to claim 1, which comprises end supporting beams, these end supporting beams supporting at least one couple of the modular elongated prefabricated floor elements only at one side, another side being provided with an anchorage within a web of each end supporting beam.

11. the constructive system according to claim 1, wherein each longitudinal groove is formed by a lower protrusion or tab and an upper protrusion or tab protruding from the vertical face of each of the long sides of each prefabricated floor element.

12. The constructive system according to claim 1, wherein each vertical face comprises a protrusion in a lower part, the longitudinal groove of each vertical face being placed above the respective protrusion.

13. Method for erecting a constructive system which comprises at least four modular elongated prefabricated floor elements, each floor element defining a longitudinal axis parallel to long sides of the floor element and a transversal axis parallel to short sides of the floor element, the floor elements comprising in a vertical face of each of the long sides a longitudinal groove having the direction of the longitudinal axis, the method comprising the steps of:

a) arranging linear supporting elements spaced between each other;

b) resting ends corresponding to the short sides of the floor elements on the linear supporting elements such that the floor elements are arranged coplanar in a 2×2 matrix configuration and such that each floor element is adjacent to another of the floor elements by one of the long sides of the floor element and adjacent to another of the floor elements by one of the short sides of the floor element, and such that a cavity is formed between each pair of adjacent floor elements by one of the long sides of each floor element;

c) arranging at least one duct which extends continuously along the cavities and a tendon inserted within the duct wherein the duct is arranged in the cavities such that in the midspan of each cavity formed between each pair of adjacent floor elements placed together by one of the long sides of each floor element, the duct is placed at the lower part of the cavities and such that at a level of each linear supporting element the duct is placed at the upper part of the cavities;

d) filling the cavities with grouting;

e) tensioning and anchoring the tendon once the grouting has hardened wherein the grouting of each cavity and each corresponding longitudinal groove results in a shear key between the prefabricated floor elements and the grouting capable of transmitting vertical shear forces.

14. The method according to claim 13, wherein in the step c) the duct and the tendon are placed simultaneously.

15. The method according to claim 13, which includes a further step of pouring a topping reinforced slab.

* * * * *